United States Patent [19]

Kelly et al.

[11] 4,434,041

[45] Feb. 28, 1984

[54] METHOD FOR CONDITIONING CARBOXYLATE/SULFONATE COMPOSITE MEMBRANES FOR PRODUCING KOH

[75] Inventors: Pilar P. Kelly, Knoxville; David D. Justice, Cleveland, both of Tenn.

[73] Assignee: Olin Corporation, New Haven, Conn.

[21] Appl. No.: 353,123

[22] Filed: Mar. 1, 1982

[51] Int. Cl.[3] ..... C25B 13/08; C25C 7/04

[52] U.S. Cl. ..... 204/296; 204/128; 204/98

[58] Field of Search ..... 204/98, 296, 128

[56] References Cited

U.S. PATENT DOCUMENTS

| | | | |
|---|---|---|---|
| 4,176,215 | 11/1979 | Molnar et al. | 204/296 |
| 4,253,923 | 3/1981 | Lynch et al. | 204/296 |
| 4,255,240 | 3/1981 | Molnar et al. | 204/296 |
| 4,332,665 | 6/1982 | Kimoto et al. | 204/296 |
| 4,360,412 | 11/1982 | Maloney | 204/98 |

*Primary Examiner*—Brian E. Hearn
*Assistant Examiner*—Gerard P. Rooney
*Attorney, Agent, or Firm*—Arthur E. Oaks; Donald F. Clements

[57] ABSTRACT

A procedure for conditioning new composite laminated membranes in chlor-alkali cells producing KOH, said membrane being comprised of a laminated composite made from individual perfluorosulfonyl and perfluorocarboxylic acid layers, so that said membrane will not delaminate during startup operation of the cell. The procedure comprises charging the cathode compartment of the cell with a KOH solution of less than about 27 percent by weight KOH before startup and gradually raising the KOH concentration during the first 12 to about 20 hours of operation to about 30 percent after which the cell can be operated at higher KOH concentrations which provide better current efficiencies.

5 Claims, 2 Drawing Figures

METHOD FOR CONDITIONING CARBOXYLATE/SULFONATE COMPOSITE MEMBRANES FOR PRODUCING KOH

This invention relates to a process for the electrolytic production of chlorine and potassium hydroxide. Potassium hydroxide is used in the manufacture of soft soap, alkaline batteries, and in the production of textiles in the fabrication of rubber.

Commercially, potassium hydroxide is produced in electrolytic cells employing asbestos diaphragms which produce a product liquor containing about 10 to about 15 percent KOH and about 10 percent KCl. This liquor is concentrated by evaporation which causes the KCl to crystallize out while providing a concentrated solution containing about 45 percent KOH and about 1 percent KCl.

U.S. Pat. No. 4,062,743 issued to Ahn et al. on Dec. 13, 1977 discloses a process for improving the reactant efficiency in an electrolytic membrane cell for production of potassium hydroxide from aqueous solutions of potassium chloride by maintaining the anolyte concentration of potassium chloride at 250 to 350 grams per liter and the catholyte concentration of potassium hydroxide from about 410 to about 480 grams per liter. The electrolytic cell employs an unmodifed permselective membrane comprised of a copolymer of a perfluoroolefin and a fluorosulfonate. However, a catholyte current efficiency of only 87 percent maximum was achieved with a concentration of potassium hydroxide at about 450 grams KOH per liter.

U.S. Pat. No. 4,065,366 issued to Oda et al. on Dec. 27, 1977 discloses a process for improving the catholyte current efficiency in an electrolytic membrane cell for the production of potassium hydroxide from aqueous solutions of potassium chloride by maintaining the anolyte concentration of potassium chloride at about 455 grams per liter and the catholyte concentration of potassium hydroxide from about 460 to about 555 grams per liter. The electrolytic cell employs a fluorinated cation exchange membrane comprised of a fluorinated copolymer having carboxylic acid groups as the ion exchange group and having an ion exchange capacity of about 0.5 to about 2.0 Meq/g/day polymer and a concentration of carboxylic acid groups of about 8 to about 30 Meq/g based on water absorbed by the membrane when contacted with an aqueous solution of the alkali metal hydroxide having about the same concentration of alkali metal hydroxide as that of the catholyte during electrolysis. A catholyte current efficiency of about 94 percent maximum was achieved at a concentration of potassium hydroxide of about 555 grams KOH per liter.

Recently, Lynch et al. in U.S. Pat. No. 4,233,122 issued Nov. 11, 1980 disclose a process for further improving the catholyte current efficiency in an electrolytic membrane cell for the production of KOH from aqueous solutions of potassium chloride by maintaining the anolyte concentration of KCl at about 250 to about 300 grams of KCl per liter and the catholyte concentration of potassium hydroxide at from about 500 to about 600 grams KOH per liter. The electrolytic cell employs a membrane comprised of a carboxylic acid substituted polymer prepared by reacting a fluorinated olefin with a comonomer having a functional group selected from the group consisting of carboxylic acid and a functional group which can be converted to carboxylic acid.

Most recently, composite membranes have been produced in the form of laminated structures comprising a first fluorinated polymer layer containing sulfonyl groups in ionizable form and a second fluorinated polymer layer containing carboxylic acid functional groups. Such laminated membranes have been disclosed in U.S. Pat. No. 4,255,240 issued to Molnar et al. on Mar. 10, 1981, and hold promise of providing significant increases in the current efficiency of chlor-alkali cells.

However, it has been found that when new, such laminated composites are extremely sensitive, particularly during cell startup procedures, to electrical or chemical excursions and if exposed to strong KOH (34 to 40 percent) during startup and for a few days thereafter, are very prone to delamination and failure. This problem can be avoided by careful conditioning of the new membranes when they are put into use. However, it is found that procedures used for single specie sulfonyl and carboxylic membranes do not work well when applied to mixed specie composite membranes. What is needed is a safe procedure for conditioning new composite membranes in a chlor-alkali cell using such a membrane so that said membrane can be safely used for relatively long periods of time.

SUMMARY OF THE INVENTION

It is an object of the present invention to provide a startup procedure to condition new laminated composite membranes in an electrolytic cell producing chlorine and potassium hydroxide, said membrane being comprised of a laminated composite made from individual perfluorosulfonyl and perfluorocarboxylic acid layers so that said composite will not delaminate during startup operation of the cell.

This and other objects of the invention will become apparent from the following description and the appended claims.

The aforementioned and other objects are achieved in the process for the preparation of potassium hydroxide, chlorine, and hydrogen in an electrolytic cell by the electrolysis of potassium chloride brine, the cell having an anolyte chamber containing an anode, a catholyte chamber containing a cathode with the anolyte chamber being separated from the catholyte chamber by a cationic permselective membrane, said membrane comprising a laminated composite comprising a first fluorinated polymer layer containing sulfonyl groups in ionizable form and a second fluorinated polymer layer containing carboxylic acid functional groups, said process further comprising controlling the catholyte flow so that the concentration of KOH is built up slowly so as to condition the several layers of the laminated membrane to withstand stronger KOH concentrations without delaminating over normal operational intervals.

DETAILED DESCRIPTION OF THE INVENTION

Electrolytic cells employed in this invention may be a commercially available or custom-built electrolytic cell of the size in an electrical capacity capable of economically producing the desired hydroxide product.

Figure 1:
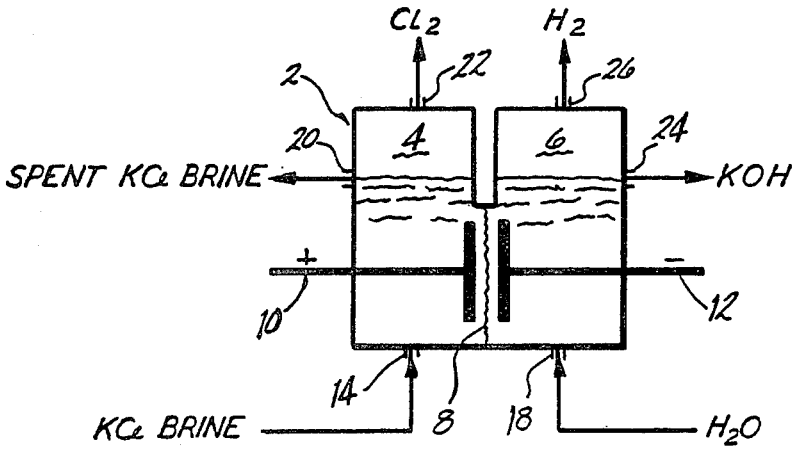
FIG. 1 is a schematic drawing of an exemplary membrane cell which can be used in the process of this invention.

A particularly advantageous electrolytic cell which may be employed in the practice of this invention is shown in FIG. 1.

Membrane cell 2 is divided into an anode compartment 4 and a cathode compartment 6 by cationic permselective membrane 8. Anode 10 is located in anode compartment 4. Examples of materials which may be employed as an anode include commercially available platinized titanium, platinized tantalum, or platinized platinum electrodes which contain, at least on the surface of the electrodes, a deposit of platinum on titanium, platinum or tantalum or platinum on platinum. Also effective are anodes composed of graphite, or anodes comprised of a metal oxide coated substrate such as ruthenium dioxide or titanium and others as described in U.S. Pat. No. 3,632,498 issued to H. B. Beer on Jan. 4, 1972 which is incorporated herein in its entirety by reference. When such electrodes are employed as anodes, anodic chlorine overvoltage is minimized. Any electrode construction capable of effecting electrolytic production of potassium hydroxide from a brine containing potassium chloride may be employed in the process of this invention.

Cathode 12 is positioned in cathode compartment 6. Examples of materials which may be employed as the cathode are carbon steel, stainless steel, nickel, nickel-molybdenum alloys, nickel-vanadium alloys, mixtures thereof and the like. Any cathode material that is capable of effecting the electrolytic reduction of water with either high or low hydrogen overvoltage may be used as cathode construction material in the process of this invention. Particularly preferred is a Raney nickel coated cathode of the type disclosed by Gray in U.S. Pat. No. 4,240,895 issued Dec. 23, 1980. This cathode is comprised of a monolithic nickel-molybdenum alloy substrate having an integral Beta structured Raney surface thereon, wherein the molybdenum comprises, by weight, between about 5 and about 20 percent of said alloy.

The cathode and anode may each be of either solid, felt, mesh, foraminous, packed bed, expanded metal, or other design. Any electrode configuration capable of effecting anodic electrolytic production of potassium hydroxide from a brine containing potassium chloride may be used as anodes or cathodes, respectively, in the process of this invention.

The distance between an electrode, such as the anode or the cathode, to the membrane is known as the gap distance for that electrode. The gap distance of the anode to membrane and the cathode to membrane are independently variable. Changing these respective distances concurrently or individually may affect the operational characteristics of the electrolytic cell and is reflected in the cell voltage and power consumption of the cell.

When using potassium chloride solution as the anolyte at a concentration in the range from about 200 to about 300 grams potassium chloride per liter, the preferable anode to membrane gap distance is in the range from about 0.0 to about 1.0 centimeters, and the preferable cathode to membrane gap distance is in the range from about 0.01 to about 1.0 and, preferably from about 0.1 to 0.5 centimeters.

A potassium chloride brine is fed through inlet 14 into anode compartment 4. The solution charged to the electrolytic cell may be made by dissolving solid potassium chloride in water, preferably deionized water, or the solution may be obtained by regenerating spent solution of potassium chloride. Minor amounts of sodium chloride, sodium bromide, potassium bromide, potassium sulfate, sodium sulfate, potassium dithionate, sodium dithionate, sodium bisulfate, potassium bisulfate, $Na_3PO_4$, $K_3PO_4$ or mixtures thereof may be present. The concentration of potassium chloride ranges from about 200 to about 300 and preferably from about 250 to about 285 grams potassium chloride per liter in the anolyte feed.

The aqueous solution of potassium chloride described above is supplied to the anolyte chamber of the electrolytic cell at a concentration described above and at a flow rate in the range from about 5 to about 20 milliliters per minute.

An electric current is applied to anode 10 to electrolytically decompose potassium chloride brine into chloride ions which form chlorine gas and potassium ions in anode compartment 4. Cationic permselective membrane 8 permits potassium ions and water to pass through to cathode compartment 6 while preventing the passage of chloride ions or chlorine gas bubbles. Water is introduced into cathode compartment 6 through inlet 18. The quantity admitted depends on the concentration of caustic desired in the discharged catholyte solution. To maintain high anodic current efficiency, spent chloride brine is continuously removed from anode compartment 4 through outlet 20. Chlorine gas is removed from anode compartment 4 through outlet 22. An aqueous solution of potassium hydroxide is obtained through outlet 24 from cathode compartment 6 with gaseous hydrogen being removed from cathode compartment 6 through outlet 26. Cell 2 can be operated on either a batch or flowthrough system. In the latter case, anolyte and catholyte are continuously circulated to and from external solution storage vessels. Typical electrolytic cells which may be employed in the preparation of aqueous solutions of potassium hydroxide in the process of this invention are disclosed in U.S. Pat. Nos. 4,062,743 and 4,233,122, supra, along with detailed descriptions of the sulfonate and carboxylate based membranes used and startup procedures therefor which are hereby incorporated by reference.

U.S. Pat. No. 4,255,240 which issued Mar. 10, 1981 to Molnar et al. discloses a new type of composite membrane having both sulfonic acid and carboxylic acid functional groups having a general formula comprising a blend of 10 to 90 percent by weight of a first fluorinated polymer which has repeating units

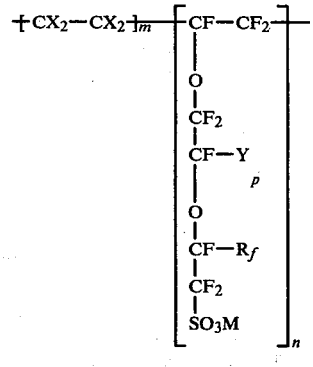

where m is 3 to 15,
n is 1 to 10,
p is 0, 1 or 2,
the X's taken together are four fluorines or three fluorines and one chlorine,
Y is F or $CF_3$,
$R_f$ is F, Cl or a $C_1$ to $C_{10}$ perfluoroalkyl radical, and
M is H or alkali metal, and 90 to 10 percent by weight of a second fluorinated polymer which has repeating units

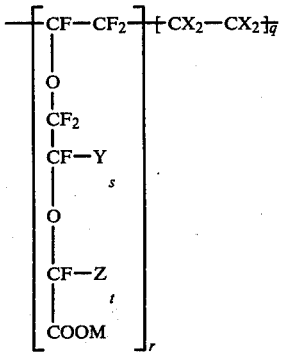

where
q is 3 to 15,
r is 1 to 10,
s is 0, 1 or 2,
t is 2,
the X's taken together are four fluorines or three fluorines and one chlorine,
Y is F or $CF_3$,
Z is F or $CF_3$, and
M is H or alkali metal.

As defined therein, each polymer preferably has an equivalent weight no greater than about 2,000 and most preferably no greater than about 1,600.

When attempts are made to apply the startup procedures outlined in U.S. Pat. Nos. 4,062,743 or 4,233,122, supra, to a cell having a laminated composite sulfonic-carboxylic acid membrane of these types described in U.S. Pat. No. 4,255,240, supra, it is found that, if the initial concentration of KOH in the catholyte exceeds about 34 percent during the startup period of at least 12 hours the membrane delaminates.

While the reason for the sensitivity during the startup is not known, it appears that at this stage of operation the sulfonate and carboxylic acid layers are dissimilar with respect to the passage of potassium ions therethrough. This difference tends to set up shear and tensile stresses at the laminate bondline which, if built up too quickly, cannot be relieved or dissipated rapidly enough to prevent the membrane from failing in service.

It has been found, however, that if the water admitted to the cathode chamber is sufficient to keep the KOH concentration in the range of about 20 to about 27 percent during the startup and early stages of cell operation, the composite membrane will not delaminate with extended use. However, with such a low concentration of KOH in the catholyte, high current efficiencies cannot be reached. It has further been found that this problem can be avoided if the KOH concentration is allowed to increase slowly over a period of at least 12 hours until it reaches a concentration of up to about 34 percent, with about 30 percent being preferred. Even better performance can be achieved if the level of catholyte KOH concentration is kept at about 30 percent for between about 15 and about 20 days, before being increased to about 34 percent. When these procedures are followed, the cell can be operated under normal operating conditions with high current efficiency, low voltage performance and high KOH concentrations for considerable periods of time without membrane delamination.

The following examples are given to illustrate the invention and are not deemed to be limiting thereof. All parts and percentages are by weight unless otherwise specified.

EXAMPLE 1

Using an electrolytic cell as exemplified in FIG. 1 with a nickel-plated stainless steel cathode and a composite laminated membrane as disclosed in U.S. Pat. No. 4,255,240, supra, the anode chamber was charged with a 25 percent KCl brine and the cathode chamber was charged with a 20 percent KOH solution. The cell was heated to 70° C. after which electrolysis was started using a current density of 0.4 $KA/m^2$. The current density was increased every five minutes by 0.4 $KA/m^2$ until a value of 2.0 $KA/m^2$ was reached and the cell temperature raised to 90° C. The concentration of KOH in the catholyte was allowed to increase gradually to 27.9 percent after 16 hours and 29.5 percent after 20 hours. Under these conditions, the cell was then operated for 49 days with an average current efficiency of 94.4 percent and an average operating voltage of 3.79 volts with no evidence of membrane degradation.

EXAMPLE 2

The method of Example 1 was repeated with the starting KOH concentration being increased to 25 percent. The KOH concentration in the catholyte solution was allowed to increase to 31.2 percent after 12.5 hours and operation continued under these conditions for 10 days. During this period, it was operated with an average current efficiency of 96.5 percent and an average operating voltage of 3.65 volts with no indication of delamination.

EXAMPLE 3

Figure 2:
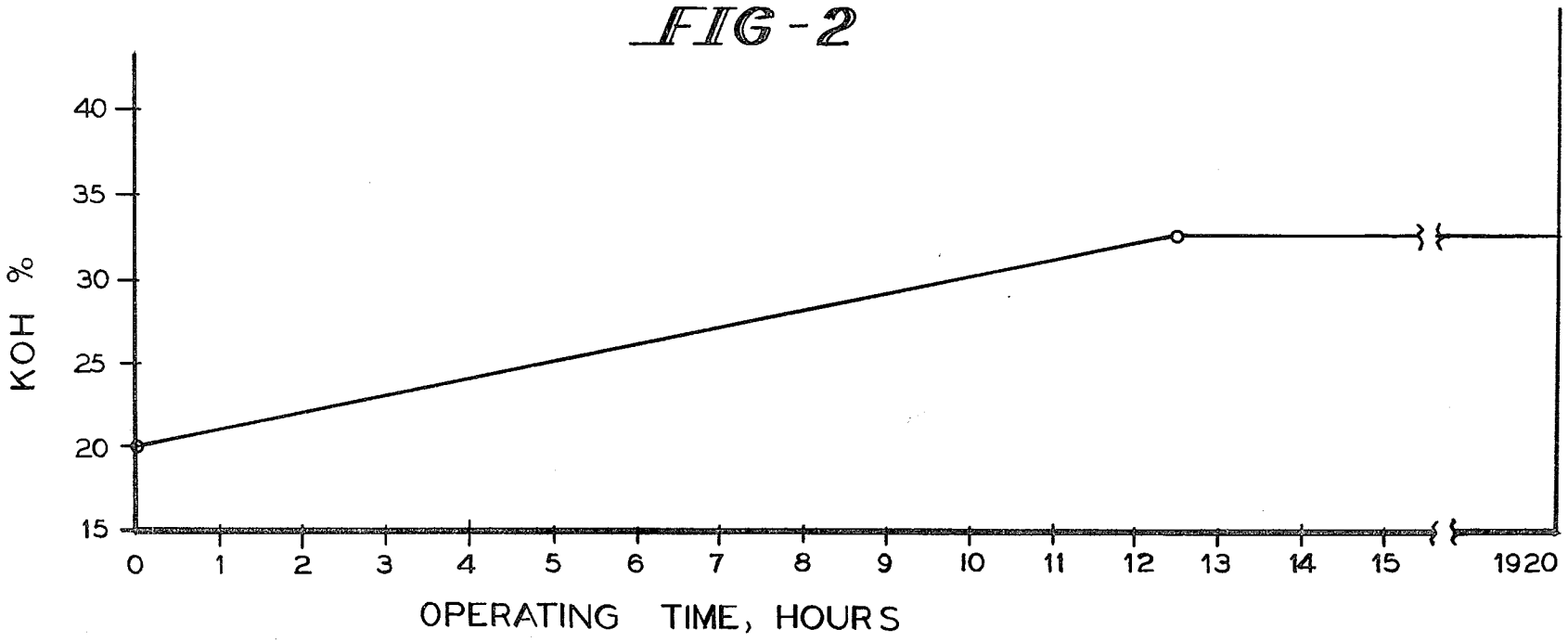
FIG. 2 is a curve illustrating one schedule for membrane conditioning according to the process of this invention.

The method of Example 1 was repeated with the KOH concentration in the catholyte being increased to 33.7 percent after 12.5 hours, after which the cell was then operated for 80 days with an average current efficiency of 95.5 percent and an average operating voltage of 3.68 volts. The schedule for this procedure is shown as FIG. 2.

COMPARATIVE EXAMPLE A

The method of Example 1 was repeated, using a starting KOH concentration of 30 percent. This concentration was raised first to 36.3 percent at 10 hours after startup and to 38.2 percent at 21.5 hours after startup. The cell voltage was high at startup and steadily increased reaching a value of 4.22 volts after two days. Visual examination of the membrane at this time showed it to be 100 percent delaminated.

EXAMPLE 4

The method of Example 1 was repeated with the nickel-plated stainless steel cathode being replaced by a Raney nickel coated cathode of the type disclosed in U.S. Pat. No. 4,240,895, supra. This cathode is comprised of a monolithic nickel-molybdenum alloy substrate having an integral Beta structured Raney surface thereon, wherein the molybdenum comprises, by weight, about 15 percent of the total weight of said alloy, and a starting KOH concentration of 25 percent. This was first raised to 29–30 percent after 20 hours of operation after which the cell was operated for 22 days. At the conclusion of this time, the KOH concentration was then raised to 33 percent, operation continuing for another 19 days, then 37 percent for two more days after which the cell was operated with a KOH concentration of 35–36 percent for a final 49 days of operation. Overall current efficiency was 96.79 percent and the average operating voltage was 3.12 volts. At the conclusion of this run, visual examination showed no evidence of significant membrane degradation.

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalence of the claims are therefore intended to be embraced therein.

What is claimed is:

1. A process for conditioning new membranes used for the production of chlorine gas, hydrogen and potassium hydroxide by the electrolysis of an aqueous solution of potassium chloride in an electrolytic cell having an anode compartment containing an anode and a cathode compartment containing a cathode, said process comprising (a) separating said anode compartment from said cathode compartment by a membrane comprised of a laminated structure comprising a first fluorinated polymer layer containing sulfonyl groups in ionizable form and a second fluorinated polymer layer containing carboxylic acid functional groups;

(b) introducing said aqueous solution of potassium chloride into said anode compartment;

(c) filling said cathode compartment with a catholyte solution comprised of an aqueous solution of potassium hydroxide having a KOH concentration of up to about 27 percent by weight;

(d) impressing an electrolyzing current between said anode and said cathode to produce chlorine gas in said anode compartment and additional KOH in said catholyte solution;

(e) slowly increasing the concentration of KOH in said catholyte over a conditioning period of at least 12 hours up to a maximum of about 34 percent by weight of KOH after said cell is started up, whereby said membrane is conditioned; and (f) then operating said cell under normal operating conditions to produce KOH catholyte of the desired concentration.

2. The process of claim 1 wherein said membrane comprises a blend of 10 to 90 percent by weight of a first fluorinated polymer which has repeating units

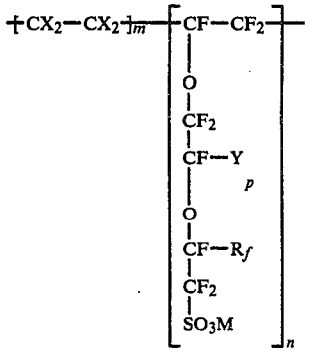

where m is 3 to 15, n is 1 to 10, p is 0, 1 or 2, the X's taken together are four fluorines or three fluorines and one chlorine, Y is F or $CF_3$, $R_f$ is F, Cl or a $C_1$ to $C_{10}$ perfluoroalkyl radical, and M is H or alkali metal, and 90 to 10 percent by weight of a second fluorinated polymer which has repeating units

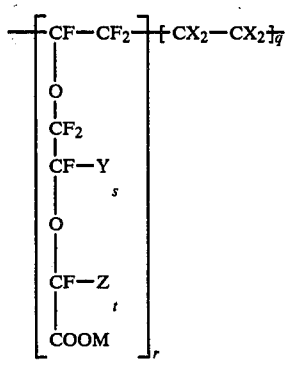

where q is 3 to 15, r is 1 to 10, s is 0, 1 or 2, t is 2, the X's taken together are four fluorines or three fluorines and one chlorine, Y is F or $CF_3$, Z is F or $CF_3$, and M is H or alkali metal.

3. The process of claim 1 wherein said catholyte solution initially has a KOH concentration in the range between about 20 and about 27 percent by weight.

4. The process of claim 1 wherein said catholyte solution is held at a KOH concentration below about 30 percent by weight for said conditioning period.

5. The process of claim 4 wherein said conditioning period is between about 15 and about 20 days.

* * * * *